US007134911B2

(12) United States Patent
Bernhart et al.

(10) Patent No.: US 7,134,911 B2
(45) Date of Patent: Nov. 14, 2006

(54) KEYED ELECTRICAL CONNECTOR WITH SEALING BOOT

(75) Inventors: William Henry Bernhart, Mount Joy, PA (US); Brent David Yohn, Newport, PA (US); John A. Fulponi, Harrisburg, PA (US); Richard Paul Walter, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 36 days.

(21) Appl. No.: 11/034,321

(22) Filed: Jan. 12, 2005

(65) Prior Publication Data

US 2006/0154522 A1 Jul. 13, 2006

(51) Int. Cl.
*H01R 13/40* (2006.01)
*H01R 13/52* (2006.01)

(52) U.S. Cl. ..... 439/587; 439/274

(58) Field of Classification Search ..... 439/587, 439/274, 275, 279, 589, 942, 455
See application file for complete search history.

(56) References Cited

U.S. PATENT DOCUMENTS

| | | | | |
|---|---|---|---|---|
| 2,958,842 | A | 11/1960 | Schaefer | 339/61 |
| 4,193,655 | A | 3/1980 | Herrmann, Jr. | 339/31 R |
| 4,214,802 | A * | 7/1980 | Otani et al. | 439/275 |
| 4,571,018 | A * | 2/1986 | Annoot | 439/281 |
| 4,808,127 | A * | 2/1989 | Swanic | 439/139 |
| 4,832,613 | A * | 5/1989 | Tsukakoshi | 439/141 |
| 5,482,299 | A * | 1/1996 | Saito | 277/604 |
| 5,707,251 | A * | 1/1998 | Sakai et al. | 439/589 |
| 5,756,972 | A * | 5/1998 | Vranicar et al. | 219/541 |
| 6,302,734 | B1 * | 10/2001 | Ichio et al. | 439/587 |
| 6,346,014 | B1 | 2/2002 | Griesser et al. | 439/680 |
| 6,669,502 | B1 * | 12/2003 | Bernhart et al. | 439/460 |

FOREIGN PATENT DOCUMENTS

| | | |
|---|---|---|
| DE | 200 22 335 U1 | 8/2001 |
| EP | 0 691 710 A2 | 1/1996 |

OTHER PUBLICATIONS

Search Report for Counterpart European Patent Application No. EP 06 10 0225, dated Apr. 25, 2006.

* cited by examiner

*Primary Examiner*—Hien Vu

(57) ABSTRACT

A seal for an electrical connector in a connector block having a connector channel with a keyway is provided. The seal includes a tubular body that defines a longitudinal axis therethrough. The body includes a forward portion defining a forward end and a rearward portion defining a rearward end. The body is configured to be received in a connector channel in the connector block. A key portion extends longitudinally along an outer surface of the body. The key portion is configured to be received in the keyway in the connector channel. The body and the key portion seal the connector channel in the connector block when the connector is loaded into the connector block.

21 Claims, 7 Drawing Sheets

KEYED ELECTRICAL CONNECTOR WITH SEALING BOOT

BACKGROUND OF THE INVENTION

This invention relates generally to electrical connectors, and more particularly, to sealed electrical connectors having axially keyed components for positioning and retaining wires and contacts in a fixed position.

Connectors exist today that are mountable to the ends of various types of coaxial cables. In certain applications, the cables carry one or more differential signals. For instance, quad cables are used for conveying high-speed data communications. The quad cables include one pair of transmit lines and one pair of receive lines, all of which are twisted in a helix to maintain a desired orientation with respect to one another. When a connector is attached to a quad cable, it is preferable to maintain the transmit and receive lines in a fixed geometry. The transmit and receive lines are connected to transmit and receive contacts which are located in a particular relation to one another within the connector. In the event that the spacing between, or overall geometry of, the transmit and receive lines and/or contacts is disturbed from a preferred configuration, particular receive and/or transmit lines begin to interact electromagnetically with one another in a detrimental manner. For example, such detrimental electromagnetic interaction may cause degradation in the signal-to-noise ratio, impedance and the like, such as cross talk and/or electromagnetic interference.

One conventional quad connector includes a tubular shell having a hollow core configured to receive a one-piece or two-piece dielectric material that hold contacts connected to conductors of the quad cable. The contacts, the dielectrics, and the shell, have keying features which interlock with one another such that the contacts resist longitudinal movement along the length of the dielectric, and to prevent movement of the dielectric within the connector shell.

In certain applications, ingress of moisture, contaminants, and corrosive elements into the shell can undesirably influence the operation and reliability of the connector. It is therefore desirable to provide a sealed connector for these applications. The keying features of the connectors, however, can be an impediment to the use of conventional sealing elements. Known sealing elements are generally ineffective because moisture, contaminants, and corrosive elements may enter the connector assembly through the keyways and circumvent the seals of the connector.

Connectors are known which are permanently sealed to prevent moisture, contaminants, and corrosive elements from reaching the internal contacts of the connector. Such connectors are disadvantaged, however, in that they are not serviceable for repair. It would be desirable to provide a sealed connector in which, for example, damaged contacts could be accessed and replaced to repair the connector, rather than replacing the entire connector assembly. Sealing a connector which is intended to be disassembled and reassembled in such a manner has proven challenging.

BRIEF DESCRIPTION OF THE INVENTION

In one aspect of the invention, a seal for an electrical connector in a connector block having a connector channel with a keyway is provided. The seal includes a tubular body that defines a longitudinal axis therethrough. The body includes a forward portion defining a forward end and a rearward portion defining a rearward end. The body is configured to be received in a connector channel in the connector block. A key portion extends longitudinally along an outer surface of the body. The key portion is configured to be received in the keyway in the connector channel. The body and the key portion seal the connector channel in the connector block when the connector is loaded into the connector block.

Optionally, the seal includes a plurality of circumferential sealing ribs formed on the outer surface. At least a portion of the sealing ribs extend from one side of the key portion to an opposite side of the key portion. The seal may be a sealing plug having a solid body; or, the seal may be a sealing boot wherein the body includes a passageway extending from the forward end to the rearward end. The passageway is configured to at least partially receive the electrical connector, and the body includes a plurality of circumferential interior sealing ribs on an interior surface of the passageway to seal an electrical cable extending therethrough.

In another aspect a connector assembly including a connector and sealing boot for a connector block having a connector channel including a keyway is provided. The assembly includes an outer connector shell having a cavity formed therein, and extending between a loading end and a mating end of the outer connector shell. A dielectric member holding contacts is received in the cavity. A sealing boot includes a tubular body defining a longitudinal axis and having a passageway extending therethrough. The body includes a key portion extending longitudinally on an outer surface thereof. The loading end of the outer connector shell is received in the passageway. The sealing boot is configured to seal the outer connector shell in the connector channel.

In yet another aspect, a sealed connector assembly is provided that includes a connector block including a mating end and a connector loading end. The connector block defines a plurality of connector channels, and each connector channel includes a keyway. Each of a plurality of connectors, is received in one of the connector channels. Each connector includes an outer connector shell having a mating end and a contact loading end. Each connector holds a plurality of contacts attached to a cable extending from the contact loading end. A sealing boot includes a tubular body defining a longitudinal axis and having a passageway extending therethrough. The contact loading end of the outer connector shell is received in the passageway. The body includes a key portion that extends longitudinally on an outer surface thereof. The key portion is received in the keyway of a respective one of the connector channels, such that the sealing boot seals the connector in the connector channel.

DETAILED DESCRIPTION OF THE INVENTION

Figure 1:
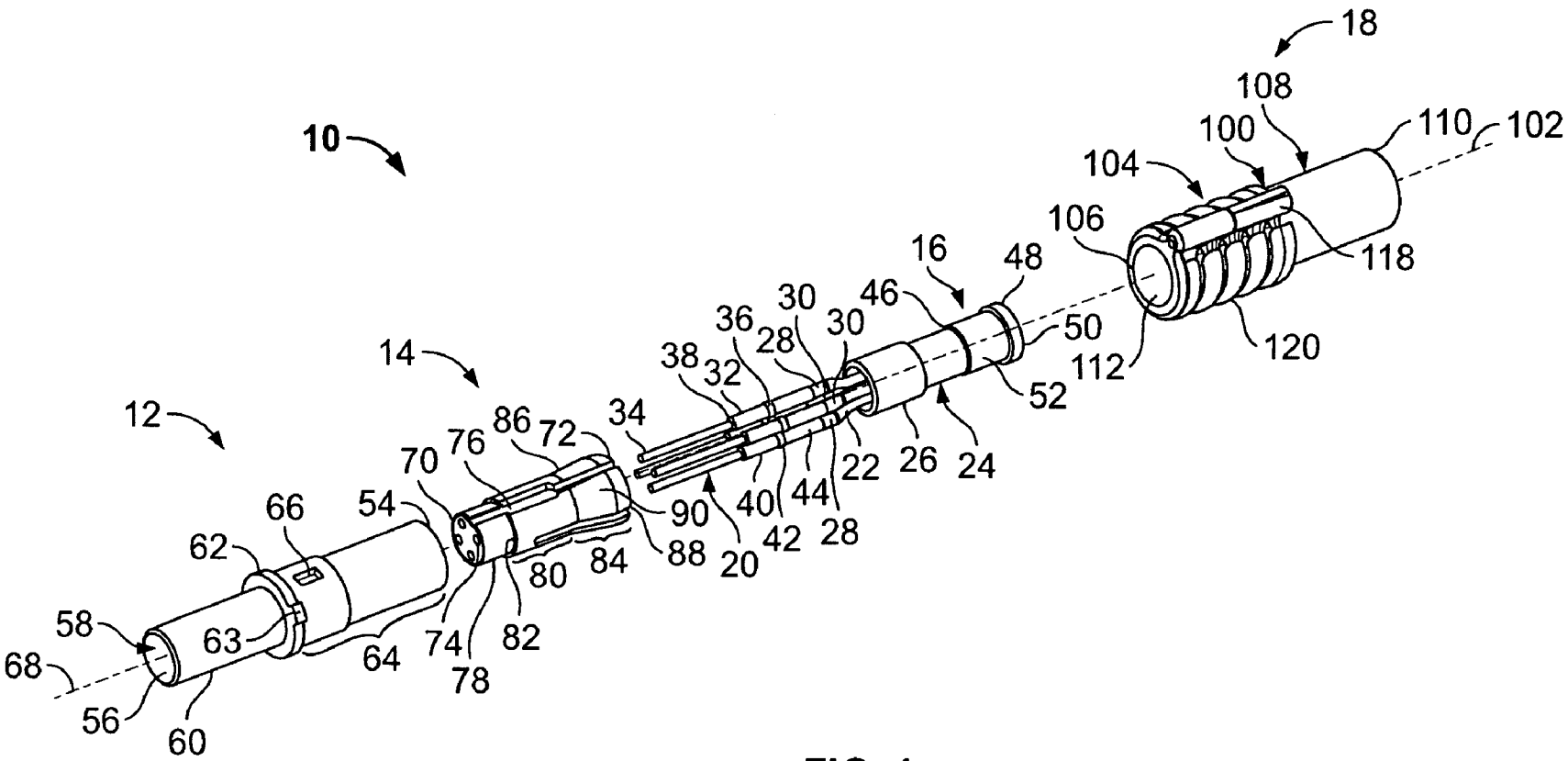
FIG. 1 illustrates an exploded view of a connector assembly and seal formed in accordance with an exemplary embodiment of the present invention.

FIG. 1 illustrates an exploded view of a connector assembly 10 formed in accordance with an embodiment of the present invention. The connector assembly 10 includes an outer shell 12 that receives therein a dielectric member 14, and a ferrule 16. A seal 18 seals a rearward portion of the assembled connector 10. A plurality of contacts 20 are mounted to corresponding signal wires 22 and inserted into the dielectric member 14. The signal wires 22 are held within a cable 24. An outer braid 26 is folded back over the cable 24 and the ferrule 16 to expose the signal wires 22 (each of which is individually insulated).

In certain applications, the signal wires 22 may be grouped into differential pairs and arranged in a particular geometry, such as a quadrature arrangement with a transmit pair 28 and a receive pair 30 as in the example of FIG. 1. Optionally, the signal wires 22 of each differential pair is positioned diagonally with respect to one another. Alternatively, the number of signal wires 22 may be varied and the geometry thereof may be changed. By way of example only, the number of signal wires 22 may be varied to include two wires, three wires, eight wires and the like.

The contacts 20 are each formed with a body section 32 having a pin 34 extending from a lead end 36 thereof. Each body section 32 has a larger diameter than the diameter of the corresponding pin 34 in order to define a flared section 38 therebetween. The body section 32 includes a raised surface defined by a front facing shoulder 40 and a rear facing shoulder 42. The flared section 38 and the shoulders 40 and 42 may be sloped or step-wise. Each body section 32 further includes a wire barrel 44 formed thereon and extending opposite to the pin 34. The wire barrel 44 is hollow and configured to receive the conductors of a corresponding signal wire 22. The wire barrels 44 may be affixed to corresponding signal wires 22 in a known manner, such as soldering, crimping, or insulation displacement and the like. Further, in alternative embodiments, the contacts 20 may include socket contacts or other well-known contact types.

The ferrule 16 includes an opening 46 extending therethrough and a rim 48 at a rear end 50 of the ferrule 16. The ferrule 16 is inserted over the contacts 20 until resting upon the cable 24. The ferrule 16 includes an exterior wall 52 that is dimensioned to be received within the braid 26 and to sandwich the braid 26 between the ferrule 16 and the outer shell 12 with the rim 48 proximate a loading end 54 of the outer shell 12.

The outer shell 12 is generally tubular in shape and is formed with a mating end 56 configured to be joined with a corresponding mating connector assembly, such as a socket connector assembly (not shown). The outer shell 12 includes a cavity 58 extending therethrough between the loading and mating ends 54 and 56. The outer shell 12 includes a lead portion 60 dimensioned to be received within the mating connector assembly. A rim 62 is provided at an interface between the lead portion 60 and a body portion 64. A positioning key 63 is formed on the rim 62. The body portion 64 includes a dimple 66 formed along the length of the body portion 64, thereby defining a keying feature that projects into the cavity 58. The dimple 66 extends in a direction parallel to a longitudinal axis 68 of the connector assembly 10 (also referred to as the center line of the outer shell 12).

The dielectric member 14 may be a unitary structure formed from a single piece of insulative material, or in alternative embodiments, may be a two piece structure. The dielectric member 14 includes front and rear ends 70 and 72 oriented along the longitudinal axis 68. A plurality of contact passages 74 are formed within the dielectric member 14 and extend between the front and rear ends 70 and 72. The contact passages 74 are formed in a predefined geometry relative to the longitudinal axis 68 of the connector assembly 10 based on the particular application and geometry of the cable 24. A keying notch 76 is formed in the exterior of the dielectric member 14 and extends rearward from the front end 70. The keying notch 76 is shaped to register with the dimple 66 projecting into the cavity 58 to orient and align the dielectric member 14 with respect to the outer shell 12. The dielectric member 14 includes a lead section 78 having a smaller diameter than an intermediate body section 80. The lead section 78 extends into the lead portion of the cavity 58 within the lead portion 60 of the outer shell 12. A rim 82 is formed on the dielectric member 14 at the interface between the lead and body sections 78 and 80, which locates the dielectric member 14 at a predetermined depth within the outer shell 12 from the mating end 56 along the longitudinal axis 68.

The dielectric member 14 also includes a flared section 84 (also referred to as a contact gripping section) formed proximate the rear end 72. The flared section 84 has an outer envelope with a larger diameter proximate the rear end 72 than the diameter of the body section 80. In the example of FIG. 1, a ramped surface 86 forms a lead-in transition area between the body and flared sections 80 and 84. Optionally, the ramped surface 86 may be formed in a stepwise manner to afford a more sharp transition, or may be more gradually sloped up to the rear end 72. As a further option, the flared section 84 may have the same diameter throughout (or even a lesser diameter throughout) than the diameter of the body section 80.

The dielectric member 14 further includes a plurality of collets 88 cut or formed therein and extending from the rear end 72 forward in a direction parallel to the longitudinal axis 68. Optionally, the collets 88 may be cut or formed in a pie or spiral pattern with respect to the longitudinal axis 68, and extending along the dielectric member 14. The collets 88 in the example of FIG. 1 are evenly distributed about the perimeter of the dielectric member 14. Alternatively, the collets 88 need not be distributed about the entire perimeter, but instead may be grouped unevenly on selected sides of the dielectric member 14. In the example of FIG. 1, the collets 88 extend through the flared section 84 into the body section 80. Alternatively, the collets 88 may terminate within the flared section 84 or may extend entirely or substantially through the body section 80. The collets 88 define a plurality of legs 90 that are clustered about, and extend parallel to, the longitudinal axis 68.

Assembly of the connector 10 is accomplished after the cable 24 is inserted through the passageway 112 of the seal 18 from the rearward end 110. The contacts 20 are then further inserted into the dielectric member 14 along the longitudinal axis 68 until the contacts 20 are in a loaded position. To insert the dielectric member 14 into the outer shell 12, the keying notch 76 of the dielectric member 14 is visually aligned with the dimple 66 of the outer shell 12, and the dielectric member 14 is inserted into the loading end 54 of the outer shell 12. Once loaded, the connector assembly 10 is assembled and the connector assembly 10 may be secured by a crimping process, such as, for example, a hex-crimp process or an O-crimp process.

The seal 18 includes a tubular body 100 that extends along a longitudinal axis 102 that is coincident with the connector axis 68. The body 100 includes a forward portion 104 defining a forward end 106 and a rearward portion 108 defining a rearward end 110. In the embodiment of FIG. 1, the seal 18 is a sealing boot that includes a passageway 112 extending from the forward end 106 to the rearward end 110. The forward portion 104 of the body 100 includes a key portion 118 and a plurality of circumferential sealing ribs 120 around at least a forward portion 104 of the body 100. The key portion 118 is configured to be received in a keyway in a connector channel (not shown). The body 100 of the sealing boot 18 is configured to receive at least a rearward portion of the assembly connector 10 including at least a part of the body portion 64 of the outer shell 12.

Figure 2:
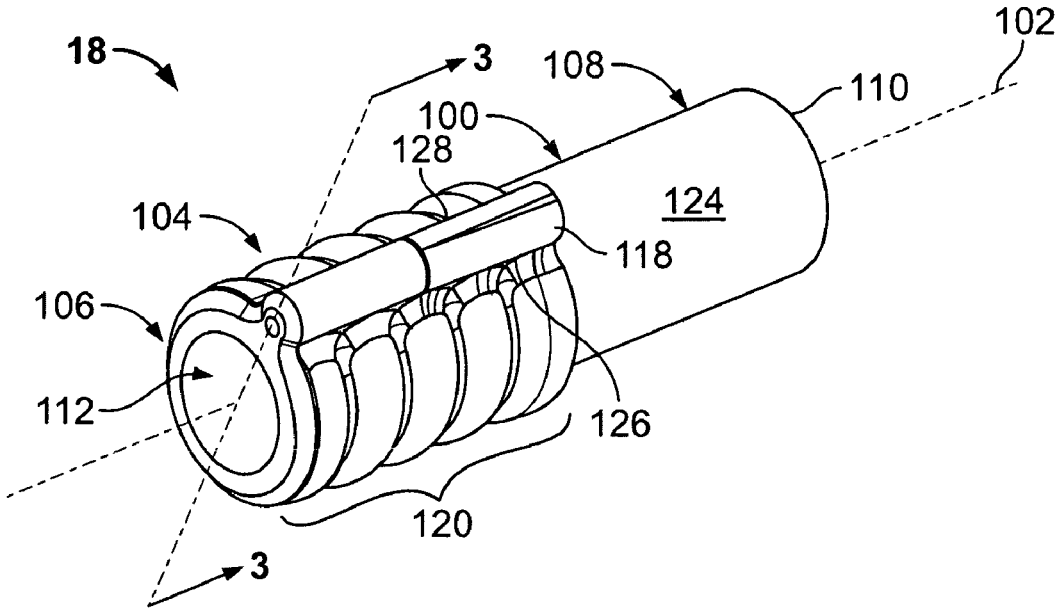
FIG. 2 illustrates a perspective view of the seal shown in FIG. 1.
Figure 3:
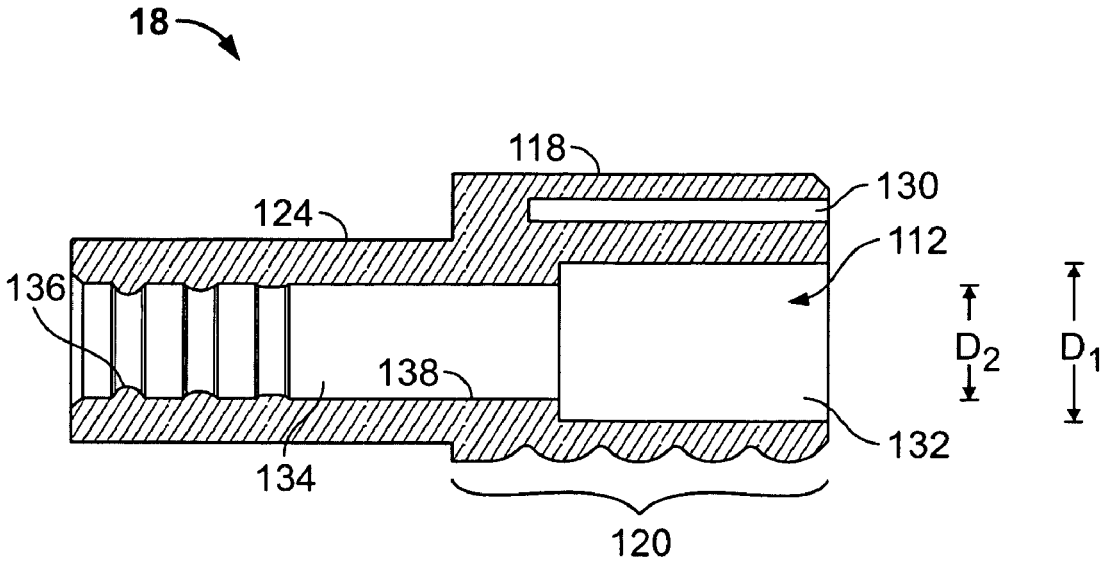
FIG. 3 illustrates a cross sectional view of the seal shown in FIG. 2 taken along the line 3—3.

FIG. 2 is a perspective view in detail of the sealing boot 18. FIG. 3 is a cross sectional view of the sealing boot 18 taken through the line 3—3 in FIG. 2. The body 100 of the sealing boot 18 includes an outer surface 124. The sealing ribs 120 and the key portion 118 are formed on the outer surface 124. In an exemplary embodiment, each of the sealing ribs 120 may include a rearward taper wherein a rearward diameter of the sealing ribs 120 is greater than a forward diameter of the sealing ribs 120. The key portion 118 includes opposite sides 126 and 128. In one embodiment, at least a portion of the sealing ribs 120 extend circumferentially from one side 126 of the key portion 118 to the opposite side 128. In other embodiments, sealing ribs 120 may also be formed on the rearward portion 108 of the body 100. In an exemplary body, the key portion 118 and the sealing ribs 120 are formed integral with the body 100. Additionally, in an exemplary embodiment, the key portion 118 includes a channel 130 that extends longitudinally part way into the key portion 118 to facilitate insertion of the sealing boot 18 into a connector channel (not shown).

The passageway 112 includes a forward cylindrical chamber 132 having a diameter $D_1$ and a rearward cylindrical chamber 134 having a diameter $D_2$ that is than less $D_1$. The forward chamber 132 is configured to receive at least part of the body portion 64 of the connector outer shell 12. The rearward chamber 134 is sized to receive the cable 24 and includes a plurality of circumferential interior sealing ribs 136 formed on an interior surface 138 of the rear chamber 134. The interior sealing ribs 136 provide sealing to prevent the rear entry of contaminants into the connector assembly 10 from around the cable 24. The sealing boot may be fabricated from rubber or other known elastic materials commonly used for sealing purposes. The material may or may not be self lubricating.

Figure 4:
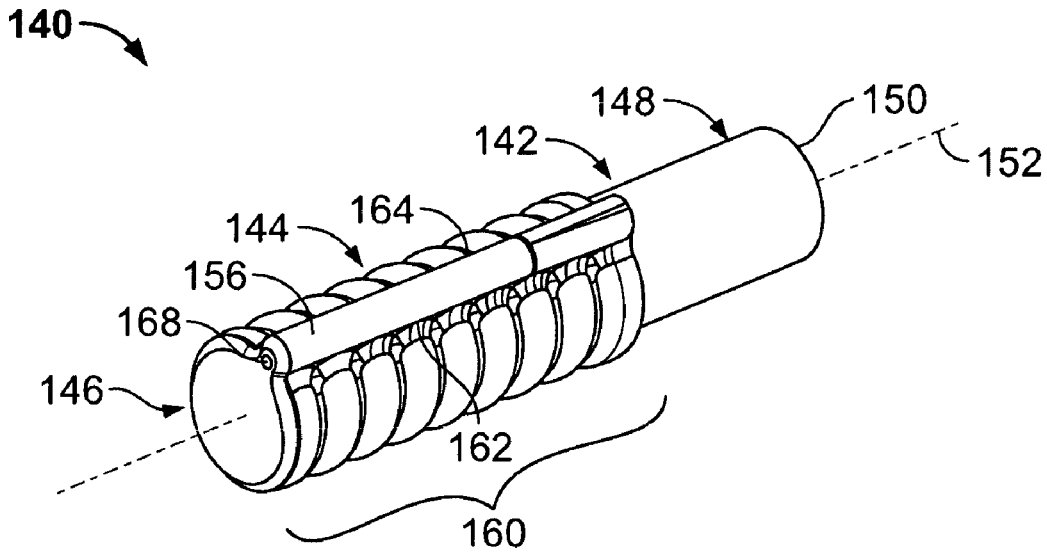
FIG. 4 illustrates a perspective view of a sealing plug formed in accordance with another embodiment of the present invention.

FIG. 4 is a perspective view of a sealing plug 140 formed in accordance with another embodiment of the present invention. The sealing plug 140 is provided to seal unused connector channels in a multi-position connector block such as the connector block 182 shown in FIG. 5. The plug 140 includes a tubular body 142 having a forward portion 144 that defines a forward end 146 and a rearward portion 148 that defines a rearward end 150. The body 142 defines a longitudinal axis 152 of the sealing plug 140. A key portion 156 extends longitudinally from the forward end 146 toward the rearward end 150. A plurality of circumferential sealing ribs 160 extend around the body 142 of the sealing plug 140 from a first side 162 of the key portion 156 to an opposite second side 164. The sealing plug body 142, in an exemplary embodiment, is a solid member without passage ways or cavities extending therethrough. In alternative embodiments, the sealing plug 142 may include partial cavities formed therein. The key portion 156 includes a channel 168 that extends from the forward end 146 of the plug 140 in a longitudinal direction partially into the key portion 156. The channel 168 is provided for ease of insertion of the sealing plug 140 into a connector channel (not shown). In an exemplary embodiment, the sealing ribs 160 are provided on the forward portion 144 of the sealing plug body 142. However, in other embodiments, sealing ribs 160 may also be provided on the rearward portion 148. Further, in an exemplary embodiment, the key portion 156 and the sealing ribs 160 may be formed integral with sealing plug body 142.

Figure 5:
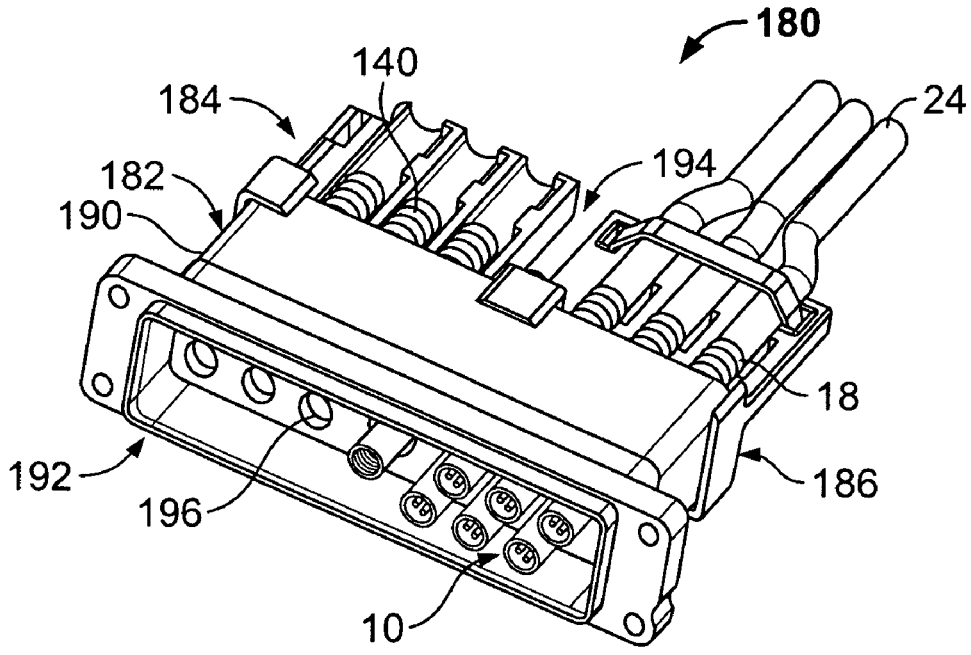
FIG. 5 illustrates a perspective view of a connector block assembly formed in accordance with an embodiment of the present invention.

FIG. 5 is a perspective view of a connector block assembly 180 formed in accordance with an embodiment of the present invention. The assembly 180 includes a connector block 182 and first and second backshell assemblies 184 and 186, respectively. The connector block 182 includes a housing 190 having a mating end 192 and a connector receiving end 194. The connector block 182 is a multi-position connector block. More specifically, the connector block 182 includes 12 connector channels 196, some of which may be loaded with connectors 10 while others may be unused. The connectors 10 are loaded into the connector block 182 with sealing boots 18, while sealing plugs 140 are installed in the unused connector channels.

Figure 6:
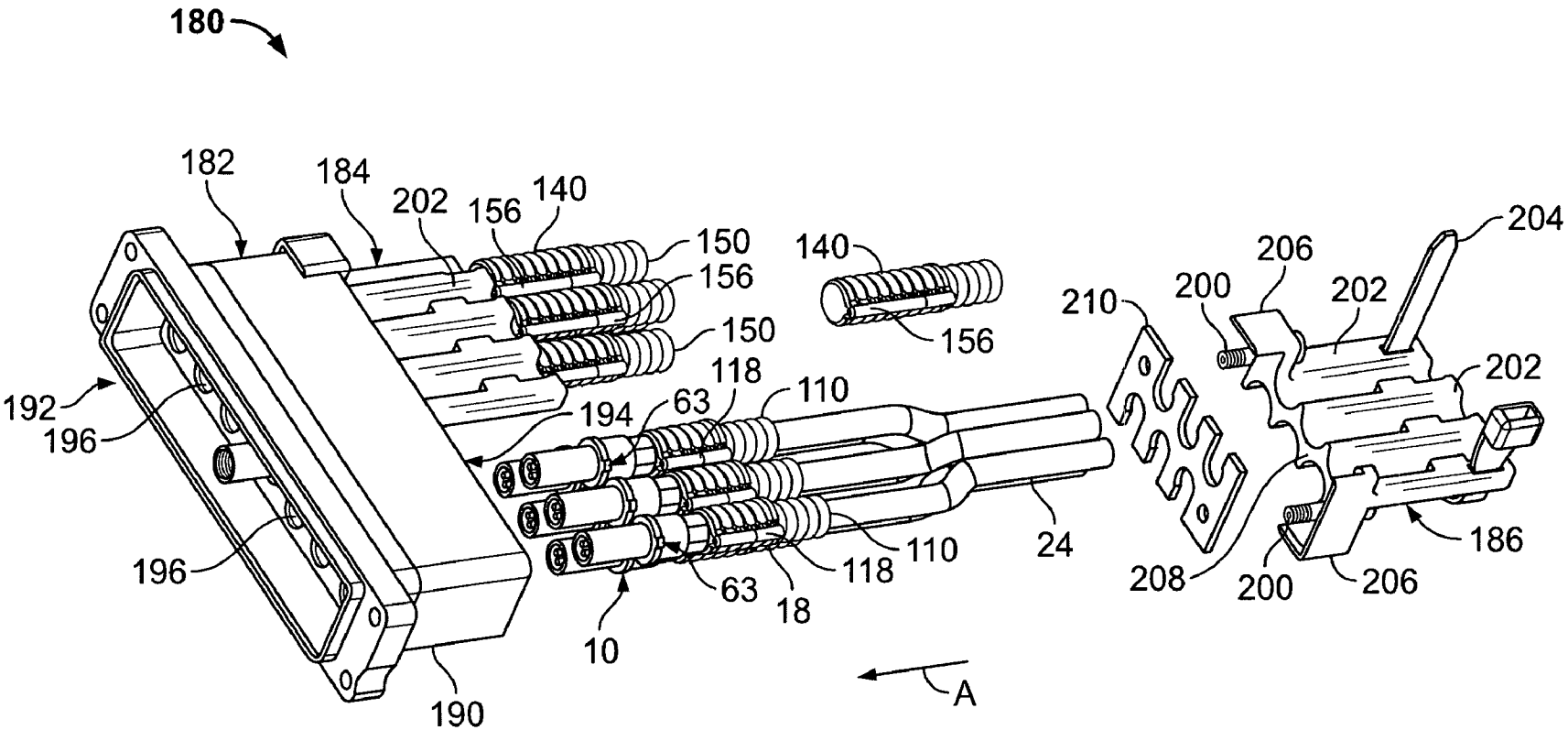
FIG. 6 illustrates an exploded view of the connector block shown in FIG. 5.

FIG. 6 is an exploded view of the connector block assembly 180 shown in FIG. 5. The connector channels 196 in the connector block 182 are irregular in shape. That is, each of the connector channels 196 includes a keyway (not shown) that extends at least partially therethrough. The keyway receives the positioning key 63 on the outer shell 12 of the connector 10 to orient the connector 10 with respect to the connector block 182. The key portions 118 on the sealing boots 18 are aligned with the positioning keys 63 and are also received in the keyways in the connector channels 196. Similarly, the sealing plugs 140 are also oriented such that the keys 156 are received in the key ways in the connector channels 196 when the sealing plugs 140 are inserted into the connector channels 196.

The backshells 184 and 186 are identical to one another but are inverted relative to one another when installed on the connector block 182. The backshells 184 and 186 each includes fasteners 200 for attachment of the backshells 184 and 186 to the connector block 182. In one embodiment, the fasteners 200 are threaded and may include captive screws. Each backshell 184 and 186 also includes cable guides 202 to organize the cables 24 at the connector receiving end 194 of the connector block 182. A cable tie 204 retains the cables 24 in the cable guides 202.

Each backshell 184 and 186 also includes a strain relief member 206 located proximate a forward face 208 of the backshells 184 and 186. The strain relief member 206, in one embodiment, is bonded to the backshells 184 and 186. In alternative embodiments, the strain relief member 206 may be formed integrally with the backshells 184 and 186. When the backshells 184 and 186 are fastened to the connector block 182, the strain relief member 206 engages rearward ends 110 and 150 of the seals 18 and plugs 140, respectively, to impart a forwardly directed load in the direction of arrow A that compresses the sealing boots 18 and the sealing plugs 140 longitudinally within the connector channels 196. The longitudinal compression causes a radial expansion of the sealing boots and the sealing plugs 18 and 140, respectively, within the connector channels 196 to enhance the sealing of the connector channels 196. In one embodiment, a sealing gasket 210 is positioned between the connector block 182 and each backshell 184 and 186. In other embodiments, the sealing gasket 210 may not be present.

In use, the assembled connectors 10 are loaded into the connector block 182 from the connector receiving end 194. The connectors 10 are oriented such that the positioning keys 63 are received in keyways (not shown) in the connector channels 196 of the connector block 182. The key portion 118 of the sealing boots 18 are then aligned with the positioning keys 63 and the keyways in the connector channels 196 and inserted into the connector channels 196 and over the rearward portion 64 (FIG. 1) of the connector outer shell 12. The cables 24 are then arranged in the cable guides 202 of the backshell 186 and the backshell 186 is attached to the connector block 182. The cables 24 are then secured to the cable guides 202 using the cable tie 204. In a similar fashion, a sealing plug 140 is inserted into each unused connector channel 196 with the key portions 156 received in the keyways (not shown) in the connector channel 196. A backshell 184 is then positioned proximate the connector receiving end 194 of the connector block 182 and the sealing plugs 140 are arranged in the cable guides 202. The backshell 184 is then attached to the connector block 182. When the backshells 184 and 186 are attached to the connector block, the strain relief members 206 apply a forward load to the sealing boots 18 and the sealing plugs 140 that compresses the sealing boots 18 and sealing plugs 140 longitudinally which causes the sealing boots 18 and sealing plugs 140 to expand radially thereby enhancing the sealing of the connector channels 196.

Figure 7:
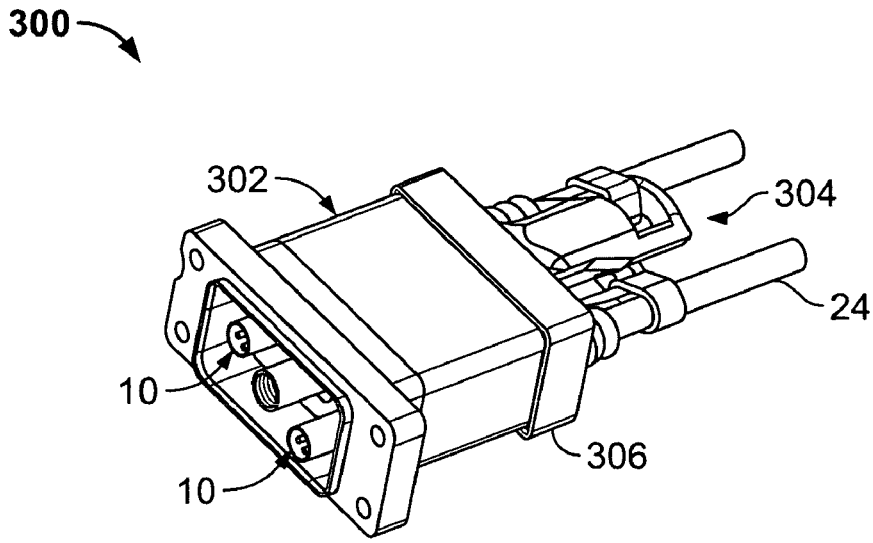
FIG. 7 illustrates a perspective view of a connector block assembly formed in accordance with an alternative embodiment of the present invention.

FIG. 7 is a perspective view of a connector block assembly 300 formed in accordance with an alternative embodiment of the invention. The connector block assembly 300 includes a two position connector block 302 and a backshell 304 that includes a strain relief member 306.

Figure 8:
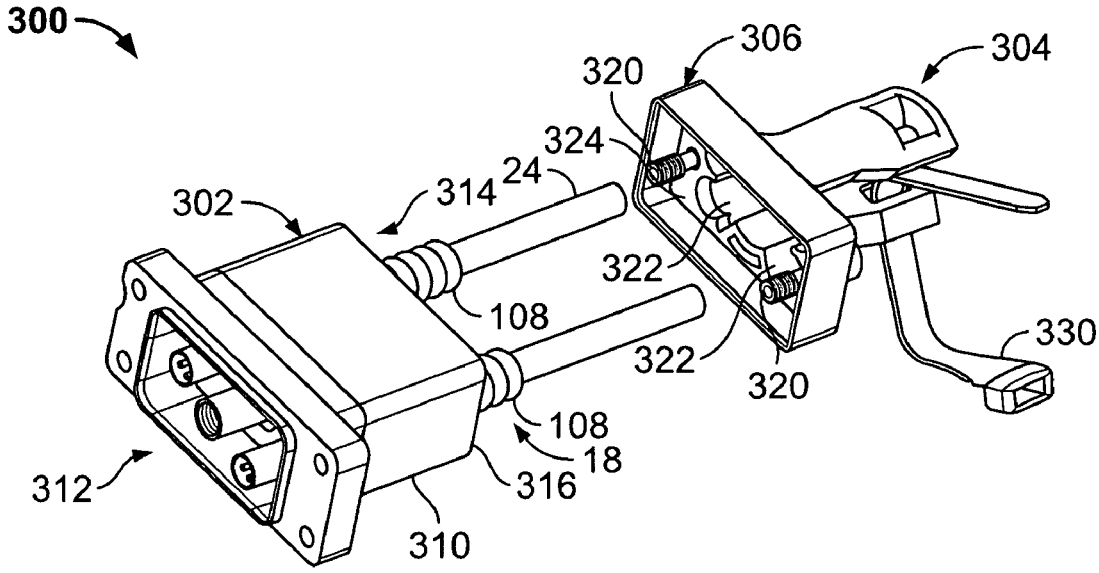
FIG. 8 illustrates an exploded view of the connector block shown in FIG. 7.

FIG. 8 is an exploded view of the connector block assembly 300 shown in FIG. 7. The connector block 302 includes a housing 310 having a mating end 312 and a connector receiving end 314. The connector receiving end 314 includes a rearward face 316. The backshell 304 includes fasteners 320 to attach the backshell 304 to the connector receiving end 314 of the connector block 302. In one embodiment, the fasteners 320 are threaded fasteners such as captive screws. The strain relief member 306 includes cable guide channels 322 that are formed in a rearward wall 324. When the backshell 304 is connected to the connecting block 302, the cables 24 and rearward portion 108 of the sealing boot 18 extend through the cable guide channels 322. Portions of the rear wall 324 proximate the cable guide channels 322 engage the sealing boot 18 to compress the sealing boots 18, causing a radial expansion of the sealing boots to enhance the sealing of the connector channels (not shown in FIG. 8) in the connector block 302. A cable tie 330 is provided to secure the cables 24 to the backshell 304. A sealing plug 140 may also be used with the connector block 302 if one of the connector channels (not shown) is unused. A gasket (not shown) may or may not be used between the connector block 302 and the backshell 304.

Figure 9:
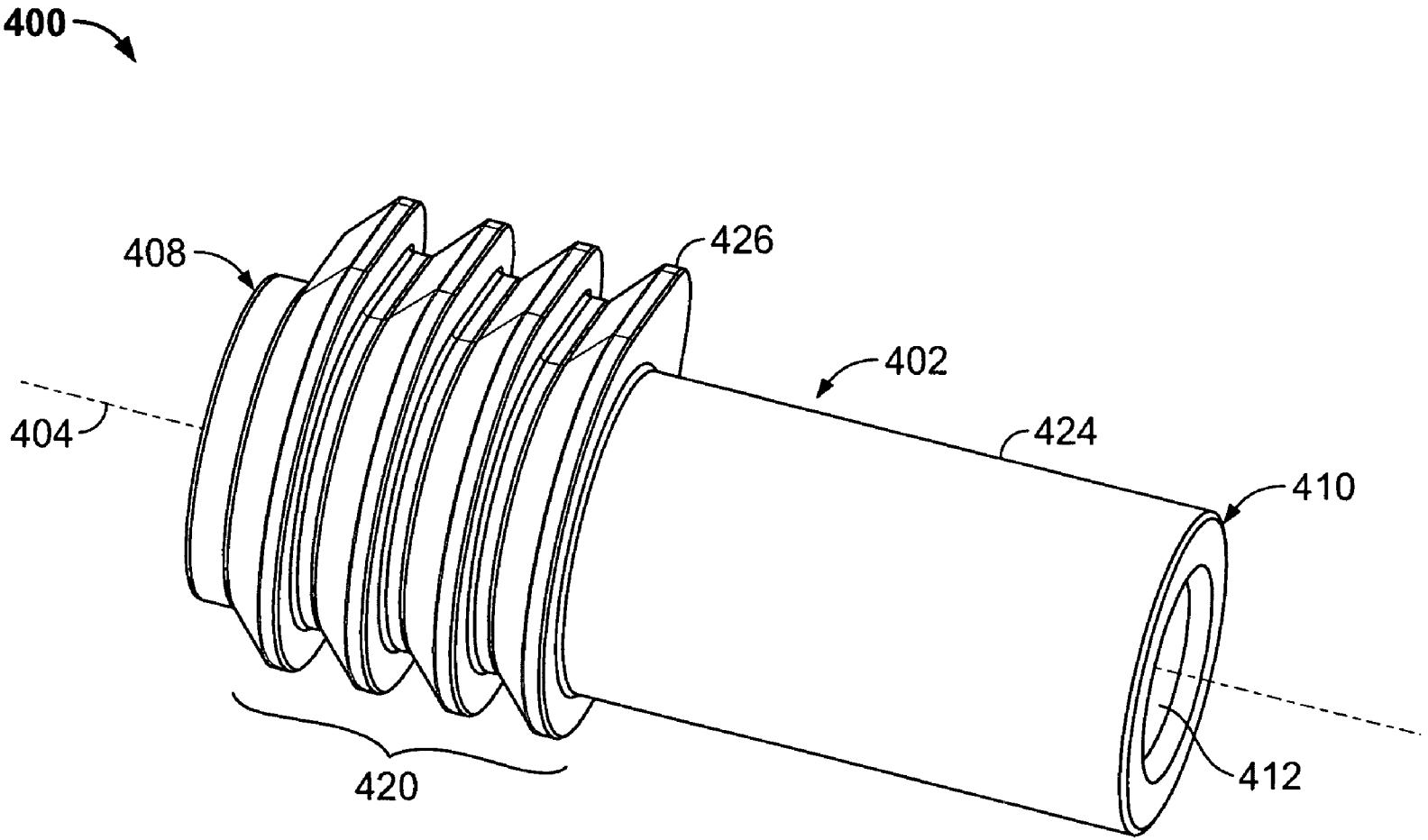
FIG. 9 illustrates a perspective view of a seal formed in accordance with an alternative embodiment of the present invention.
Figure 10:
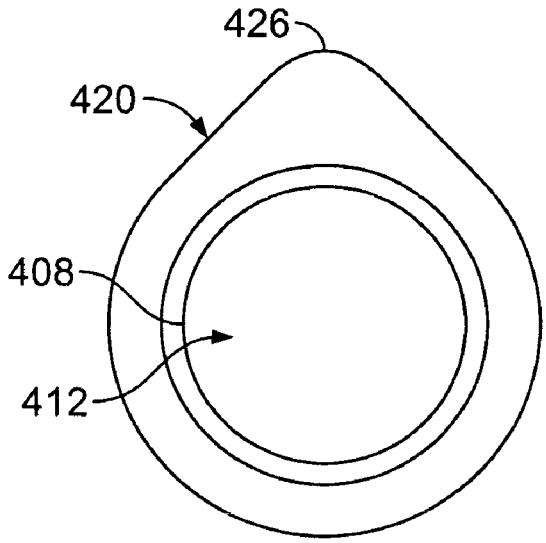
FIG. 10 illustrates a front view of the seal shown in FIG. 9.
Figure 11:
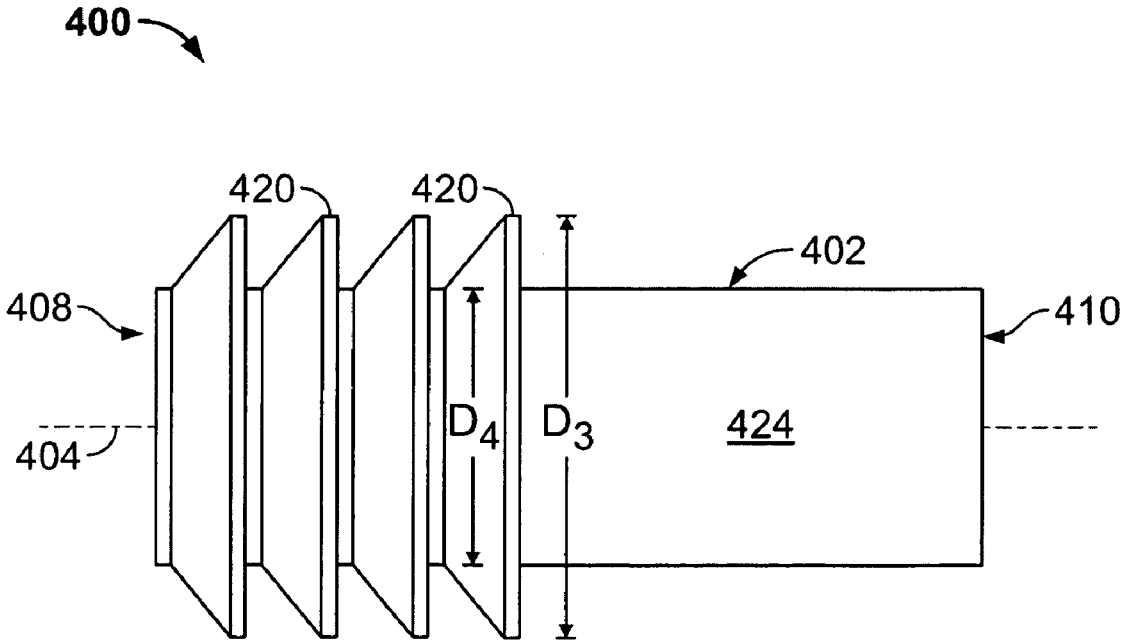
FIG. 11 illustrates a side view of the seal shown in FIG. 9.

FIG. 9 illustrates a perspective view of a seal 400 formed in accordance with an alternative embodiment of the present invention. FIG. 10 illustrates a front view of the seal 400. FIG. 11 illustrates a side view of the seal 400. The seal 400 includes a body 402 that extends along a longitudinal axis 404. The seal body has forward end 408 and a rearward end 410. A passageway 412 extends longitudinally through the seal body 402 from the forward end 408 to the rearward end 410. A plurality of sealing ribs 420 are formed on an outer surface 424 of the seal body 402. The sealing ribs 420 extend circumferentially around the seal body 402 and are longitudinally spaced along the seal body 402. The sealing ribs 420 are variable in number and may or may not be located along a full length of the seal body 402.

Each of the sealing ribs 420 includes a key portion 426 formed thereon. The key portion 426 is configured to be received in the keyway of a keyed connector channel (not shown). As shown in FIG. 10, the sealing ribs 420 with the key portion 426 impart a tear or pear shape to the outer periphery of the seal 400 when viewed from the forward end 408 or rearward end 410. The sealing ribs 420 exhibit a conical shape or rearward taper wherein a rearward diameter $D_3$ of each sealing rib 420 is greater than a forward diameter $D_4$ as shown in FIG. 11. Note that in FIG. 11, the key portions 426 of the sealing ribs 420 are not in view.

The above-described embodiments provide a cost effective and reliable sealing boot 18 for a connector assembly 10. Specifically, the connector assembly 10 includes an outer shell 12 having a positioning key 63 that is used to orient the connector assembly 10 in a connector channel having a keyway in a connector block 182. The sealing boot 18 includes a key portion 118 that is configured to be received in the keyway and a plurality of circumferential sealing ribs 120 on the outer body 100 of the sealing boot 18. The sealing ribs 120 and the key portion 118 cooperate to seal the irregularly shaped keyed connector channel 196. A passageway 112 extends through the sealing boot 18 to receive a rearward portion 64 of the connector assembly 10 and a cable 24 to which the connector assembly 10 is attached. Interior sealing ribs 136 on the interior of the passageway 112 provide sealing between the cable 24 and the sealing boot 18. A strain relief member 206 compresses the sealing boot 18 longitudinally to expand the sealing boot 18 radially to improve the pressure of the sealing boot 18 against the connector channel walls. A solid sealing plug 140 is provided to seal unused connector channels 196 in the connector block 182.

Exemplary embodiments of a sealing boot 18, 400 and a sealing plug 140 for keyed connector applications are described above in detail. The sealing boot 18, 400 and sealing plug 140 are not limited to the specific embodiments described herein, but rather, may include variations consistent with the basic component designs. For example, the sealing boot 18, 400 and sealing plug 140 may include sealing ribs 120, 160, 420 along the full length of the sealing boot and plug bodies 100, 142, 402. Likewise, the key portions 118, 156, 426 of the sealing boot 18, 400 and sealing plug 140 may also extend the full length of the sealing boot and plug bodies 100, 142, 402.

While the invention has been described in terms of various specific embodiments, those skilled in the art will recognize that the invention can be practiced with modification within the spirit and scope of the claims.

What is claimed is:

1. A seal for an electrical connector in a connector block having a connector channel with a keyway, the electrical connector having an outer connector shell with at least one contact loaded therein, said seal comprising:

a tubular body defining a longitudinal axis therethrough, said body including a forward portion defining a forward end and a rearward portion defining a rearward end, said body further comprises a passageway extending from said forward end to said rearward end, said passageway configured to receive and, sealably engage the outer connector shell of the electrical connector; and a key portion extending longitudinally along an outer surface of said body, said key portion configured to be received in the keyway in the connector channel of the connector block, said body and said key portion sealably engaging the connector channel in the connector block when the connector is loaded into the connector block;

wherein said key portion defines a longitudinal channel extending partially therein to facilitate insertion of the seal into the connector channel.

2. The seal of claim 1, wherein said body includes a plurality of circumferential sealing ribs formed on said outer surface.

3. The seal of claim 1, wherein said body includes a plurality of circumferential interior sealing ribs on an interior surface of said passageway to seal an electrical cable extending therethrough.

4. The seal of claim 1, wherein said body includes a plurality of circumferential sealing ribs formed on said outer surface, and at least a portion of said sealing ribs extend from one side of said key portion to an opposite side of said key portion.

5. The seal of claim 1, wherein said body includes a plurality of circumferential sealing ribs formed on said outer surface, and said key portion and said sealing ribs are formed integral with said body.

6. The seal of claim 1, wherein said seal is fabricated from a self lubricating elastic material.

7. The seal of claim 1, wherein the passage includes forward and rearward chambers proximate the forward and rearward ends of the tubular body, respectively, the forward and rearward chambers having different diameters and being configured to receive the outer connector shell and a cable, respectively.

8. A connector assembly including a connector and a sealing boot configured to be inserted into a connector channel in a connector block, the connector channel including a keyway, said connector assembly comprising:

an outer connector shell having a cavity formed therein, said cavity extending between a loading end and a mating end of said outer connector shell;

a dielectric member holding contacts received in said cavity; and a sealing boot comprising a tubular body defining the longitudinal axis and having a passageway extending therethrough, said body including a key portion extending longitudinally on an outer surface thereof, said loading end of said outer connector shell being received in said passageway, and wherein said sealing boot sealably surrounds the outer connector shell and is configured to sealably engage the connector channel in the connector block.

9. The connector assembly of claim 8, wherein said body includes a plurality of circumferential sealing ribs formed on said outer surface.

10. The connector assembly of claim 8, wherein said body includes a plurality of circumferential interior sealing ribs on an interior surface of said passageway, said interior sealing ribs being configured to seal a cable extending from said dielectric member.

11. The connector assembly of claim 8, wherein said body includes a plurality of circumferential sealing ribs formed on said outer surface, and at least a portion of said sealing ribs extend from one side of said key portion to an opposite side of said key portion.

12. The connector assembly of claim 8, wherein said body includes a plurality of circumferential sealing ribs formed on said outer surface, and said key portion and said sealing ribs are formed integral with said body.

13. The connector assembly of claim 8, wherein the passage includes forward and rearward chambers, the forward and rearward chambers having different diameters and being configured to receive the outer connector shell and a cable, respectively.

14. A sealed connector assembly comprising:

a connector block including a mating end and a connector loading end, said connector block including a plurality of connector channels, each of said connector channels including a keyway;

a plurality of connectors, each said connector received in one of said connector channels, each said connector including an outer connector shell having a mating end and a contact loading end, each said connector holding a plurality of contacts attached to a cable extending from said contact loading end; and a sealing boot comprising a tubular body defining a longitudinal axis and having a passageway extending therethrough, said contact loading end of said outer connector shell being received in said passageway, and said body including a key portion extending longitudinally on an outer surface thereof, and wherein said key portion is received in said keyway of a respective one of said connector channels, such that said sealing boot seals said connector in said connector channel.

15. The sealed connector assembly of claim 14 further comprising a plurality of sealing plugs, for sealing connector channels having no connector therein, each said sealing plug including a tubular body defining a longitudinal axis, and a key portion extending longitudinally along said plug body, said key portion received in said keyway in one of said connector channels, said sealing plug sealing said connector channel.

16. The sealed connector assembly of claim 14, wherein unused connector channels include sealing plugs and said sealed connector assembly further comprises a strain relief member adjacent said connector loading end of said connector block, said strain relief member engaging said sealing boots and sealing plugs to compress and expand said sealing boots and sealing plugs in said connector channels.

17. The sealed connector assembly of claim 14, wherein said outer shell includes a positioning key and said key portion is aligned with said positioning key when said outer shell and said sealing boot are loaded in the connector channel.

18. The sealed connector assembly of claim 14, wherein said body includes a plurality of circumferential sealing ribs formed on said outer surface.

19. The sealed connector assembly of claim 14, wherein said body includes a plurality of circumferential interior sealing ribs on an interior surface of said passageway, said interior sealing ribs being configured to seal a cable extending from said dielectric member.

20. The sealed connector assembly of claim 14, wherein said body includes a plurality of circumferential sealing ribs formed on said outer surface, and at least a portion of said sealing ribs extend from one side of said key portion to an opposite side of said key portion.

21. The sealed connector assembly of claim 14, wherein the passage includes forward and rearward chambers, the forward and rearward chambers having different diameters and being configured to receive the outer connector shell and a cable, respectively.

* * * * *